US006619079B2

(12) United States Patent
Cheung

(10) Patent No.: US 6,619,079 B2
(45) Date of Patent: Sep. 16, 2003

(54) SECURITY DEVICE FOR MEDIA STORAGE DISK BOX

(76) Inventor: Chung Fai Cheung, 17th Floor, Yan's Tower, No. 25-27 Wong Chuk Hang Road, Aberdeen (HK)

( * ) Notice: Subject to any disclaimer, the term of this patent is extended or adjusted under 35 U.S.C. 154(b) by 0 days.

(21) Appl. No.: 10/033,953

(22) Filed: Dec. 28, 2001

(65) Prior Publication Data

US 2003/0121296 A1 Jul. 3, 2003

(51) Int. Cl.[7] ..... B65D 85/67

(52) U.S. Cl. ..... 70/57.1; 206/308.1; 206/387.11; 206/1.5

(58) Field of Search ..... 70/57.1, 63; 206/1.5, 206/308.1, 308.2, 387.11

(56) References Cited

U.S. PATENT DOCUMENTS

| | | | | | |
|---|---|---|---|---|---|
| 4,819,797 | A | * | 4/1989 | Holmgren | 206/309 |
| 5,039,982 | A | * | 8/1991 | Bruhwiler | 206/1.5 X |
| 5,375,712 | A | * | 12/1994 | Weisburn | 206/387 |
| 5,588,315 | A | * | 12/1996 | Holmgren | 70/57.1 |
| 5,597,068 | A | | 1/1997 | Weisburn et al. | 206/308.1 |
| 5,680,782 | A | * | 10/1997 | Komatsu et al. | 70/63 X |
| 5,760,689 | A | | 6/1998 | Holmgren | 70/57.1 X |
| 5,762,187 | A | * | 6/1998 | Belden, Jr. et al. | 206/308.2 |
| 5,779,039 | A | * | 7/1998 | Ambrus | 206/308.2 |
| 5,782,350 | A | * | 7/1998 | Weisburn et al. | 206/308.2 |
| 5,823,341 | A | * | 10/1998 | Nakasuji | 206/387.11 |
| 5,901,840 | A | * | 5/1999 | Nakasuji | 206/1.5 |
| 5,931,291 | A | * | 8/1999 | Sedon et al. | 206/1.5 |
| 5,934,114 | A | * | 8/1999 | Weisburn et al. | 70/57.1 |
| 5,984,388 | A | | 11/1999 | Bacon | 206/387.11 X |
| 5,988,376 | A | * | 11/1999 | Lax | 206/308.2 |
| 6,102,200 | A | | 8/2000 | Dressen et al. | 206/308.2 |
| 6,182,480 | B1 | * | 2/2001 | Kim | 70/57.1 |
| 6,202,454 | B1 | * | 3/2001 | Nakasuji | 70/57.1 |
| 6,336,554 | B1 | * | 1/2002 | Bruhwiler | 206/308.2 |
| 6,374,648 | B1 | * | 4/2002 | Mitsuyama | 70/57.1 |

FOREIGN PATENT DOCUMENTS

| | | |
|---|---|---|
| GB | 2346870 | 8/2000 |

* cited by examiner

*Primary Examiner*—Suzanne Dino Barrett
(74) *Attorney, Agent, or Firm*—Ostrolenk, Faber, Gerb & Soffen, LLP

(57) ABSTRACT

In a storage box for a disk, the lid and the base of the box are hinged along one side. A security bar holds the lid and base closed. The security bar has one surface with pairs of pins at intervals therealong. The lid and the base have respective pin receiving regions, such as openings, which receive the pins of each pair to hold the box closed. A latch on the security bar projects into an internal latching region in the box to prevent removal of the security bar. The latch is rotatable by an insertable key to a release condition to release the security bar for removal.

14 Claims, 9 Drawing Sheets

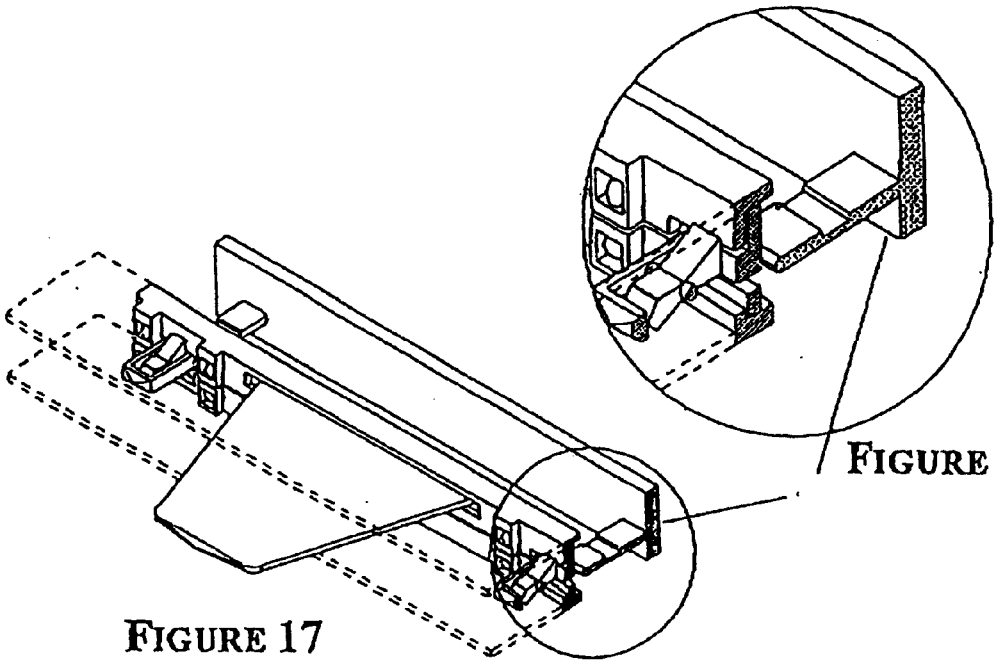
FIGURE 18
FIGURE 17
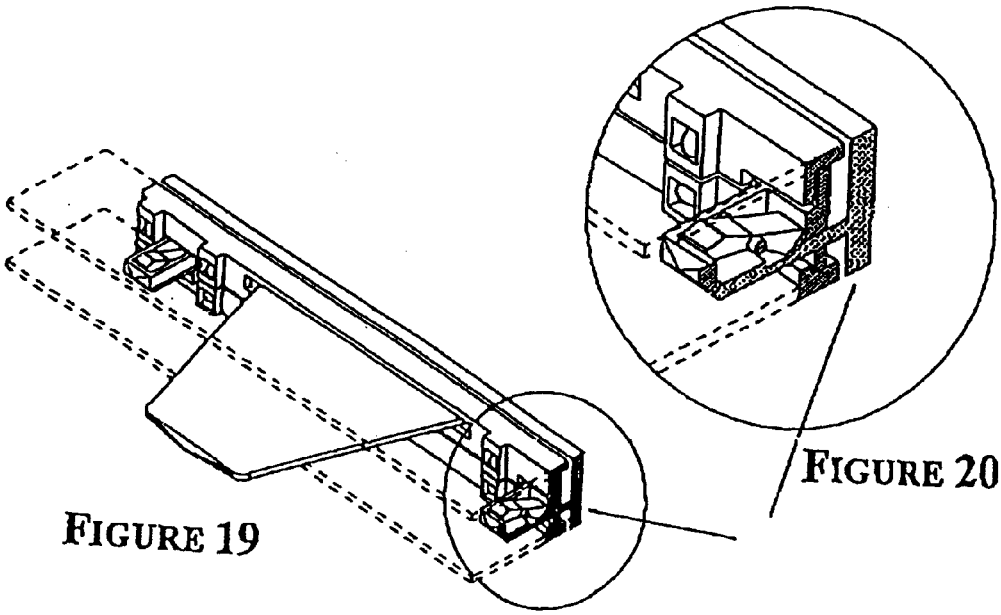
FIGURE 20
FIGURE 19

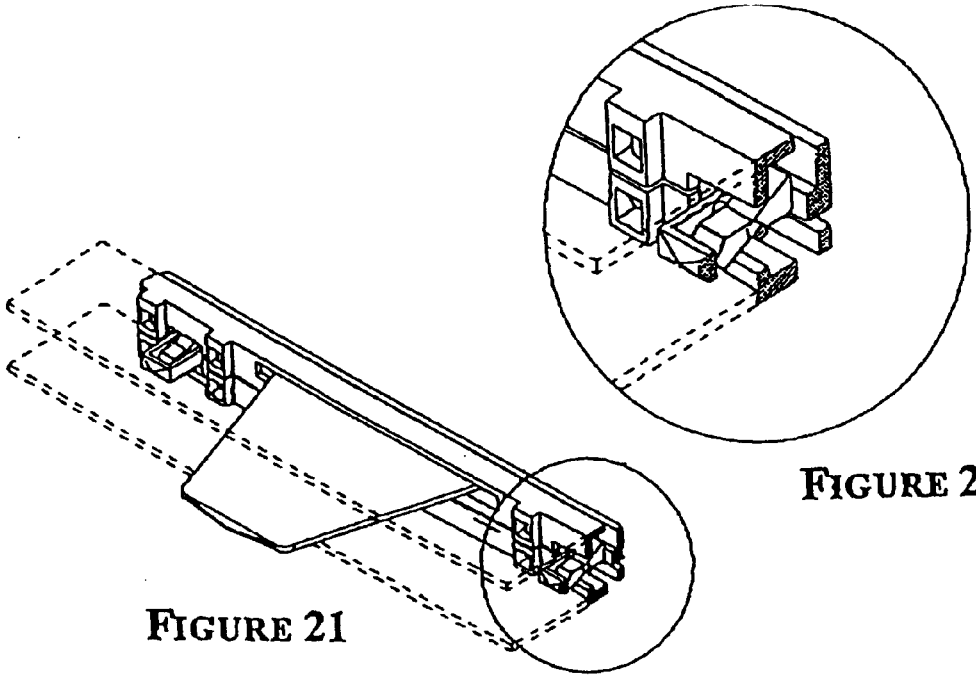
FIGURE 22
FIGURE 21
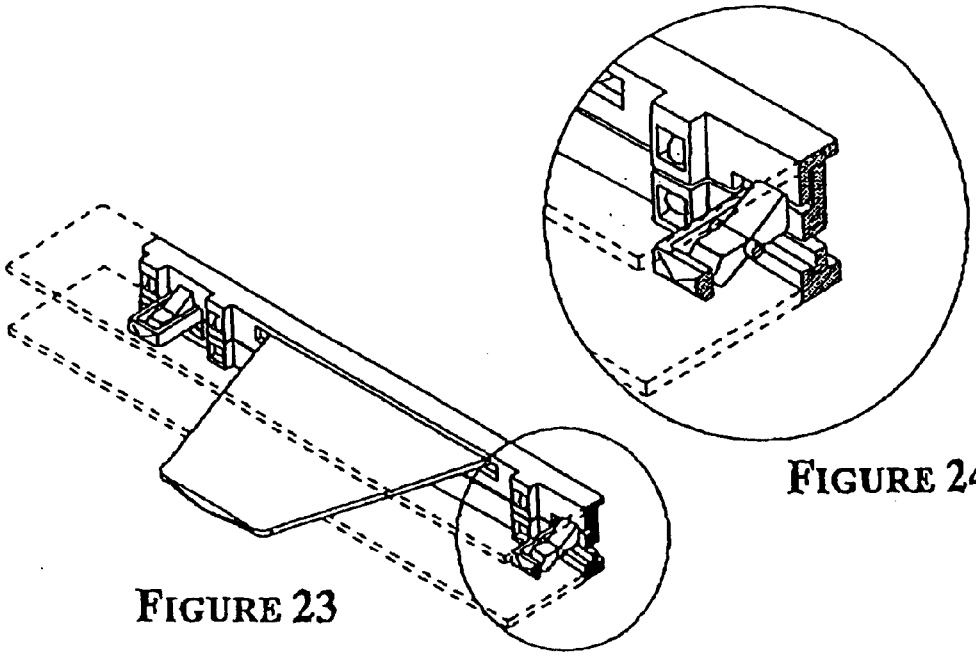
FIGURE 24
FIGURE 23

SECURITY DEVICE FOR MEDIA STORAGE DISK BOX

FIELD OF THE INVENTION

The present invention relates to a security device for media storage disk box.

BACKGROUND OF INVENTION

In retailing of media storage disks such as compact disks, video disks, digital video disks or the like, security in the prevention of shop lifting of such product is a major concern to the retailer. While the product must be placed on display to allow for a potential purchaser to make his or her purchasing decisions, because of the size of such disks, they can be easily taken and hidden by a shop lifter. The disks are normally presented for retail in a box which contains the advertising and other information that is relevant to the consumer in making the purchasing decision. The use of AM security tags in conjunction with such boxes is one way of preventing theft. An AM security device sensor at the entrance of the retail outlet can trigger an alarm upon the removal of a box containing an activated AM device from the retail outlet. However since the value of the product is in the disk and not the box, shop lifters are known to remove the disks from the box thereby allowing them to leave the store undetected since the AM device is integral with the box and not the removed disk.

Mechanisms to prevent the opening of a box had been designed to prevent the convenient removal of disks from the box. For example, U.S. Pat. No. 5,760,689 discloses a transparent cassette in which the box retaining the goods to be displayed can be housed. The device provides a means to lock the goods within the cassette and also provides wireless actuation means for an electronic alarm system. A special key is required to open the cassette to allow the removal of the contents for the sale and purchase transaction to take place.

U.S. Pat. No. 5,984,388 describes the use of an adhesive security tag which is applied to a CD case to bind the two halves of the CD case together and prevent convenient removal of the disk from the case. U.S. Pat. No. 5,984,388 also discloses the use of electronic sensors to prevent removal of the entire case without an alarm going off. Similarly, U.S. Pat. No. 6,102,200 describes a security package for use in retail sales to lock the goods to be retailed within a clear plastic case, wherein the security package includes a locking means requiring unlocking with a special key as well as electronic surveillance tag for perimeter security of the goods on display within the store.

While such devices may be effective at preventing shop lifting, they do present disadvantages. Having to place a disk box within a second box can detract from the visual effect of displaying the goods for sale. The placement of goods to be retailed within such a box also increases the volume per item hence requiring more space for the storage and display of the goods to be retailed. The transparent material used for such devices will also over time become damaged and the transparency will be reduced thereby reducing the effectiveness of the visual advertising provided on the disk boxes within such cartridges. Furthermore such cartridges can be expensive, particularly since the material required to produce such a cartridge is high in light of the cartridge having to encompass the entire disk box.

BRIEF DESCRIPTION OF THE INVENTION

It is accordingly desirable to incorporate a security device with an existing style of disk box without such disadvantages.

Accordingly it is an object of the present invention to provide a security device for a media storage disk box which overcomes the abovementioned disadvantages or which will at least provide the public with a useful choice.

A first aspect of the present invention comprises a media storage disk box in combination with a security bar and associated key element the box comprising a base portion and a lid portion hingingly engaged to said base portion to be movable between an open condition to provide access to product within said box and a closed condition to provide a substantial enclosure of said product within said box, in said closed condition the juncture between said lid portion and said base portion defining a seam, a lock pin receiving region on each side of said seam provided in each of said base and lid portion, an internal latching region the security bar slidably engageable with said box between a locking position and a removed position, said security bar comprising at least one pair of locking pins, each pin engagable with and preferably into a respective lock pin receiving region which when in the locking position to thereby prevent movement of said lid and said base from said closed condition, latching means including a latch having a latching position which when said security bar is in the locking position with respect to said box is latched with said internal latching region to prevent movement of said security bar to at least the extent where said lock pins are removed from their respective lock pin receiving region said associated key element adapted to engage the latching means to move the latch from its latched position to allow the movement of said security bar from its locking position.

A second aspect of the present invention comprises a security bar for use with a media storage disk box of a kind providing a base portion and a lid portion hingingly engaged to said base portion to be movable between an open condition to provide access to product within said box and a closed condition to provide a substantial enclosure of said product within said box, in said closed condition the juncture between said lid portion and said base portion defining a seam, the security bar slidably engagable with said box between a locking position and a removed position, said security bar comprising at least one pair of lock pins, each pin engagable with a respective lock pin receiving region on each side of said juncture provided in each of said base and lid portion to thereby prevent movement of said lid and said base from said closed condition latching means including a latch having a latching position which when said security bar is in the locking position with respect to said box is latched with an internal latching region of said box to prevent movement of said security bar to at least the extent where said lock pins are removed from their respective lock pin receiving region until such time a key element is engaged with the latching means to release the latch from its latching position to allow the movement of said security bar from its locking position.

Preferably, the latching means is engaged to a body portion of said security bar and holds said latch in a pivotable manner to be pivotable between said latching position and a release position.

Preferably, when pivoted to said latching position, the latch, when the security bar is fully engaged with the box, locates against the internal latching region of said box.

Preferably, the box provides a side wall opening when in the closed condition through which said latching means is moveable between the security bar locked position and removed position.

Preferably, the internal latching region is a flange.

Preferably, each of the base and lid portion includes side wall upstands which when the box is in the closed condition, define the side walls of the box.

Preferably, the latching means includes an actuation means mounted for movement to the body to be engagable by the associated key element, the actuation means being moveable upon the engagement of the associated key element to thereby move said latch from said latching position.

Preferably, the latch includes an actuation region to be engagable by the associated key element, the actuation region being moveable upon the engagement of the associated key element to thereby move said latch from said latching position.

Preferably, the side wall opening of said box, when the security bar is in the locking position with said box, also allows for a portion of said key element to be inserted internally into said box for the actuation of said latch.

Alternatively a separate opening in said box is provided to allows for a portion of said key element to be inserted internally into said box for the actuation of said latch.

Preferably the body portion of said security bar is a plate shaped portion

Preferably said plate shaped portion is a strip.

Preferably said strip is of a length and height less than the length and height of a said side wall of said box (when in the closed condition) with which said security bar is to engage.

Preferably an opening is provided in the plate portion of said security bar, which when said security bar is in the locking position with said box is aligned with said side wall opening of said box, the actuation portion of said key element can extend through said opening of said security bar.

Preferably when said security bar is in said locking position with said box, said strip overlies the side wall openings of said box save for the provision of a said opening of said security bar provided through said face plate.

Preferably said security bar moves into its locking position in a sliding manner in a direction substantially parallel with the major surfaces of the lid and base portion (when closed).

Preferably said security bar engages with the side of said box opposite to the hinged side.

Preferably said box is a rectangular box, wherein said hinged side is one of said major sides.

Preferably said pin receiving regions are provided in the side wall upstands of each of said lid and base portion.

Preferably said pin receiving regions are apertures through said side wall upstands of each of said lid and base portion.

Alternatively said pin receiving regions are rebates through said side wall upstands of each of said lid and base portion.

Preferably said pins are of a complementary shape to said apertures or rebates of said side wall upstands and are slidably engagable therein.

Preferably said latching means includes a latch mounting portion which is disposed from a portion of said body of said security bar and extends substantially lateral to the plate of said security bar.

Preferably said latch mounting means provides a pivot means to mount said latch in a pivotable manner about an axis which is, when being engaged with said box, substantially parallel to the major surfaces of said base and lid portion and substantially transverse to the direction of sliding engagement.

Preferably said latch mounting means is integrally mounded as part of said security bar.

Preferably said latching means is integrally mounded as part of said security bar.

Preferably said latch mounting means is integrally mounded with said pivot means and said latch.

Preferably said latch is mounted from said latch mounting means to in a natural condition be in said latching position and able to be moved by a stressing of said pivot means to said release condition.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF DRAWINGS

FIG. 17 is a perspective view of part of the cover with which and at which the security bar is engaged also illustrating the key to be used for the removal of the bar from the cover, FIG. 18 is a close-up perspective view of part of FIG. 17, FIG. 19 illustrates the key fully engaged with the cover and the security bar to allow for the security bar to then be removed from the cover, FIG. 20 is a close-up perspective view of part of FIG. 19, FIG. 21 is a perspective view of part of the cover and security bar prior to the security bar being fully engaged with the cover, FIG. 22 is a close-up perspective view of part of FIG. 21, FIG. 23 illustrates the security bar in a fully engaged and locked condition with the cover, FIG. 24 is a close-up perspective view of part of FIG. 23.

DETAILED DESCRIPTION OF THE INVENTION

Figure 1:
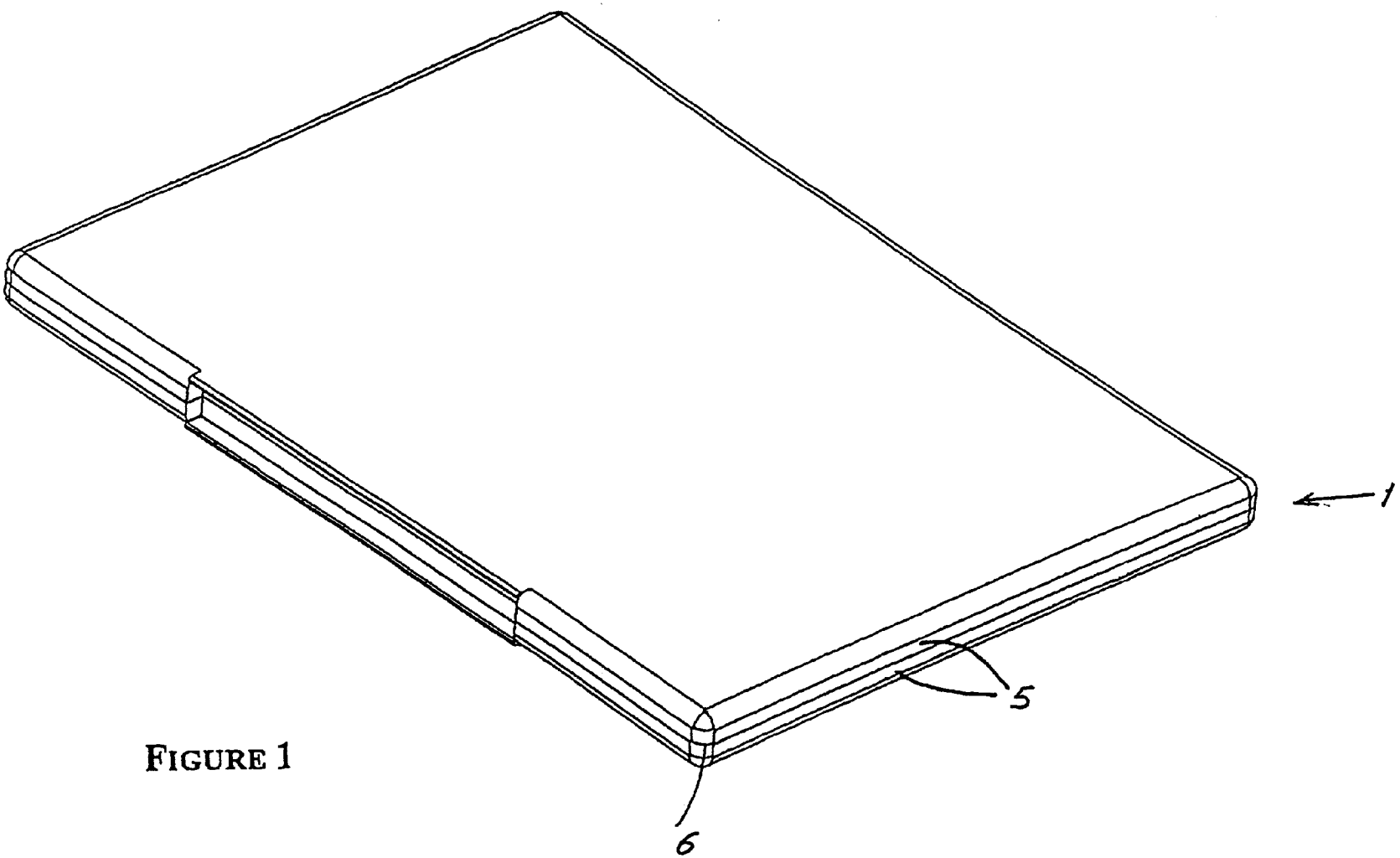
FIG. 1 is a perspective view of a box for storage of a disk.
Figure 2:
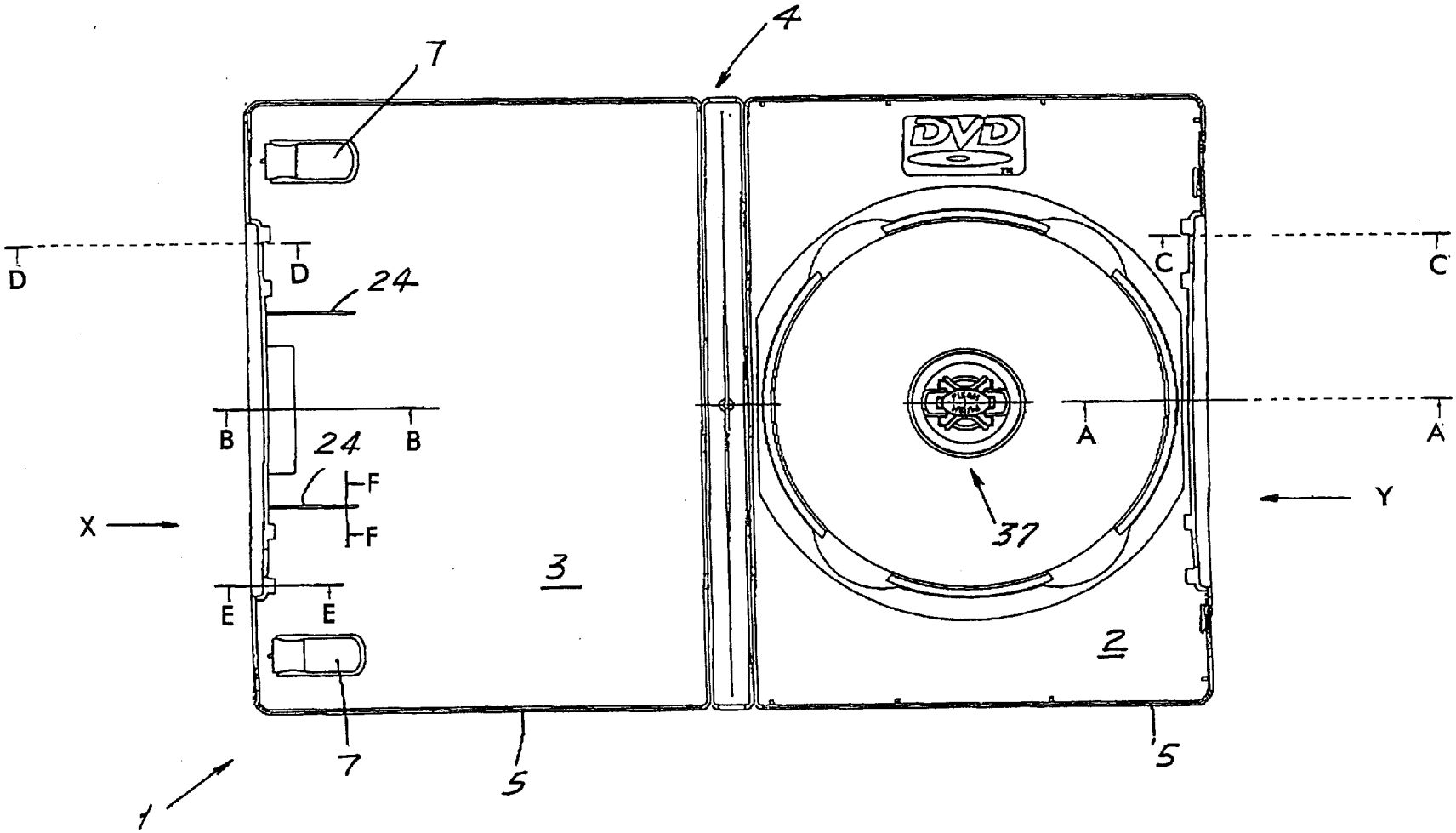
FIG. 2 is a plan view of a box of FIG. 1 in an open and laid flat condition.

FIG. 1 illustrates a perspective view of a box for storing a disk such as a DVD, CD, VCD or the like. The box 1 is preferably of a substantially rectangular shape when in a closed condition and provides a full enclosure to the disk stored therein. With reference to FIG. 2, there is shown the box of FIG. 1 in plan view and in an open condition. The box 1 is comprised of a base portion 2 and a lid portion 3, both rectangularly shaped. These are secured to each other in a hinged manner by a hinging means 4 extending between the base and lid portions. The box 1 provides the hinging feature 4 between one of the longer of the four edges of each of the rectangularly shaped lid and base portions. The hinge allows the base and lid portions to move between an open and closed condition. In the open condition, access can be gained to the disk supported by a central support means 37 of the base portion 2. The central support means is preferably a push button support means of any type commonly used in such boxes, and it is able to secure a disk at its central aperture.

Each of the lid and base portions also includes a side wall upstand 5 along three of the edges, excluding the edge engaged to the hinging means 4. The side wall upstands 5 of the base and lid portion are provided to mutually engage with each other when the box is in a closed condition and provide a seam 6 at the opposing and/or abutting and/or mating edges of the side wall upstands 5 of both the lid and base portions.

For many disks that are sold, written information may also accompany the disk. The example of disk box 1 shown in FIG. 2 includes clipping means 7 which are provided to clip a booklet or other written material information to the inside wall of the lid portion 3.

Figure 3:
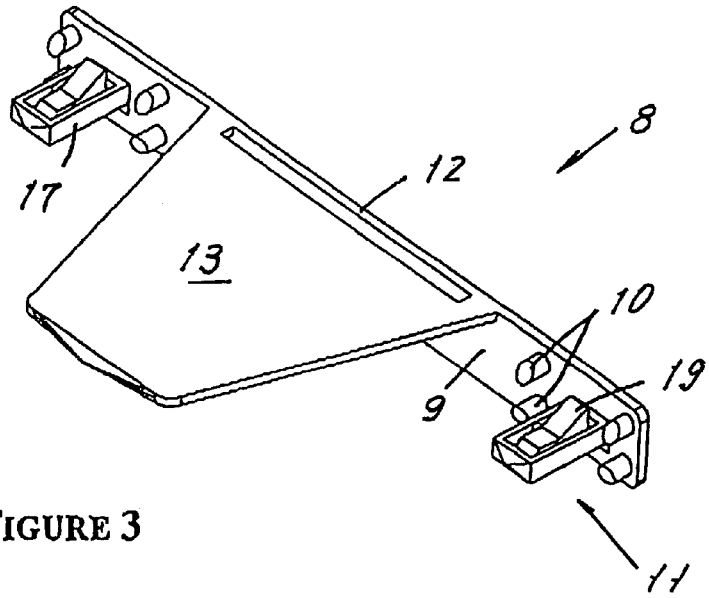
FIG. 3 is a perspective view of security bar for use in conjunction with the box of FIG. 2.

The security bar 8 as shown in FIG. 3 comprises a face plate 9 having a front surface that is inaccessible in the locking condition. There projects from the front surface at least one pair of security pins 10. As seen in FIG. 3, four pairs of security pins project from the front surface of the face plate 9 of the security bar 8. Also projecting from the front surface of the face plate 9 is at least one and preferably two latching means 11.

Figure 25:
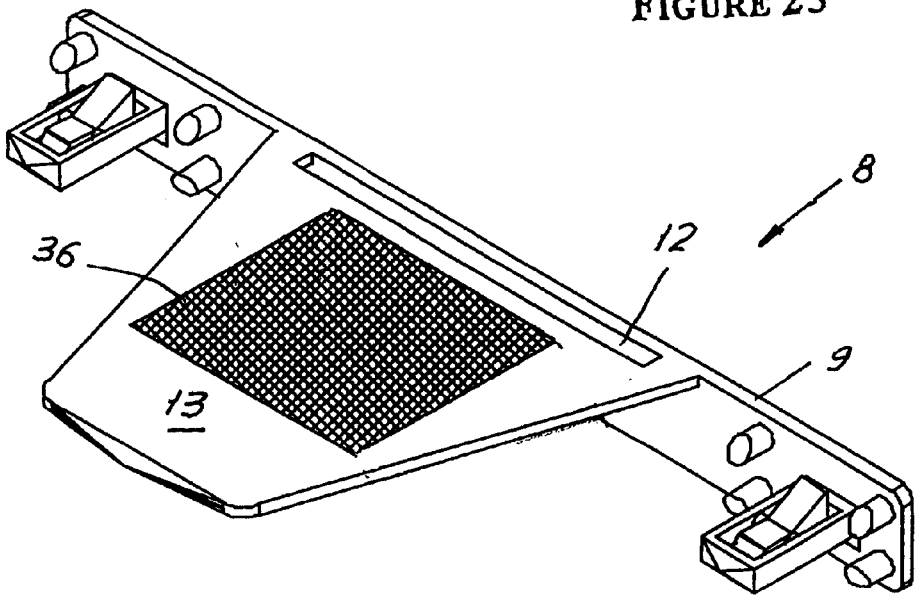
FIG. 25 is a top perspective view like FIG. 3 of the security bar with one form of security label, an RF label.
Figure 26:
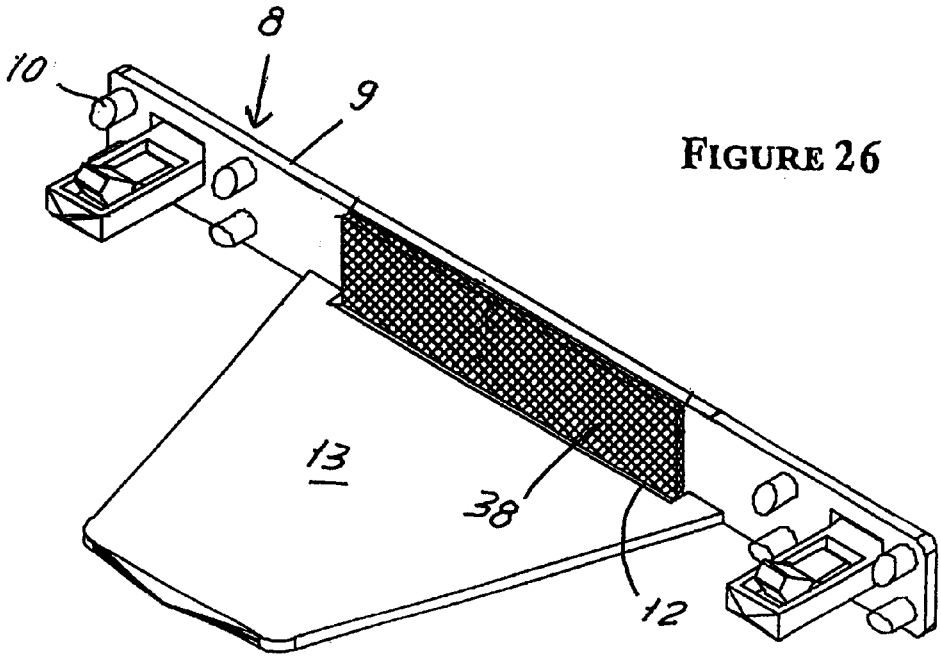
FIG. 26 is a bottom perspective view of the security bar with another form of security label, an AM label.

The security bar preferably also has provisions for securing or housing a component of electronic article surveillance. Such a component may be a security tag of an AM, EM or RF label. The security bar in FIG. 3 may be provided with a planar member 13 extending forward from the face plate to an extent sufficient to allow for it to carry, either internally or secured thereon, an RF label 36, as shown in FIG. 25, which label is normally larger than an AM tag. An AM type tag may for example be inserted into the slot 12 shown in FIGS. 3 and 26 and rest against the front surface of the face plate 9. While the security bar of the present invention is shown in the form in FIG. 3, the planar member need not be provided if an RF security tag is not to become engaged with the security bar.

Figure 4:
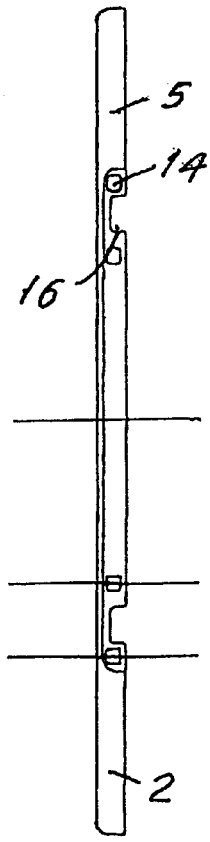
FIG. 4 is an end view in direction X of FIG. 2.
Figure 5:
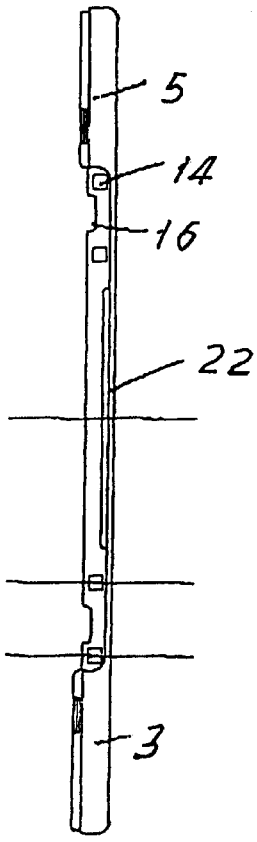
FIG. 5 is an end view of the box in direction Y of FIG. 2.
Figure 6:
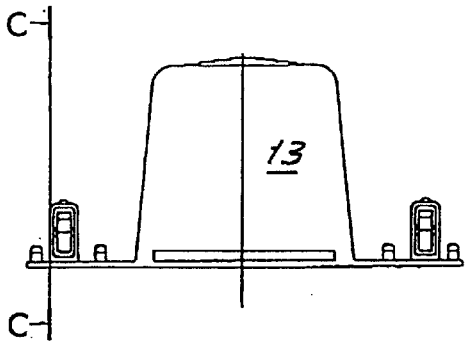
FIG. 6 is a plan view of the security bar of FIG. 3.

In use, the security bar 8 of the present invention is to become engaged with appropriate portions of the box 1 to thereby secure the box 1 in a closed condition to remain closed until such time as the security bar is removed. For receiving the security bar, the box is provided in the side wall upstands in each of the lid and base portion with a respective pin receiving region, particularly here an opening 14, into which one of a respective pair of the pins 10 can engage. There are respective sets of an opening in the side wall upstands in the base and in the lid in FIGS. 4 and 5 for each pair of pins 10 in FIG. 3. With reference to FIG. 5, the opening 14 in the lid portion 3 is provided opposite to the opening in the base portion 2 as shown in FIG. 4. When the lid and base portions are brought together to provide the box in the closed condition, a respective opening 14 of one pair is provided on each side of the seam 6. The security bar is engageable with the box by inserting a pin of each pair into a respective opening 14 of the box. Once the pins are inserted into their respective openings in the box, the box can then not be opened.

In the most preferred form, the security bar is engaged to provide pins extending into respective openings 14 along the edges of the base and lid portions opposite to where the hinge 4 is provided. The movement of the security bar for engagement with the box is in a direction substantially parallel with the major surfaces of the lid and base portion when these are in the closed position.

With reference to FIGS. 14A–F, there is shown the sequence of the pin 10 being inserted into the openings 14 of the box on each side of the seam 6. When fully engaged as for example shown in FIG. 14F the base can then not be pivoted away from the lid towards the open position of the box. The box is in this condition hence effectively locked closed.

Figure 8:
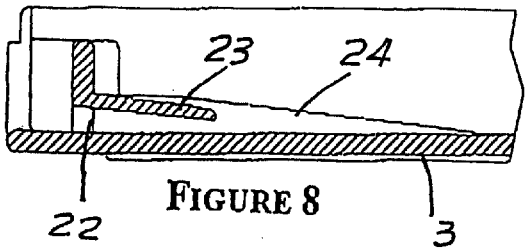
FIG. 8 is a sectional view through section B—B of FIG. 2.
Figure 9:
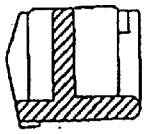
FIG. 9 is a sectional view through section A—A of FIG. 2.
Figure 10:
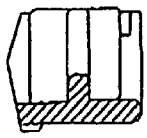
FIG. 10 is a sectional view through section C—C of FIG. 2.
Figure 11:
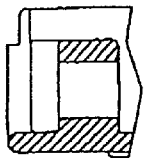
FIG. 11 is a sectional view through section E—E of FIG. 2.
Figure 12:
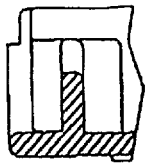
FIG. 12 is a sectional view through section D—D of FIG. 2.
Figure 13:
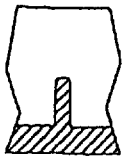
FIG. 13 is a sectional view through section F—F of FIG. 2.
Figure 14A:
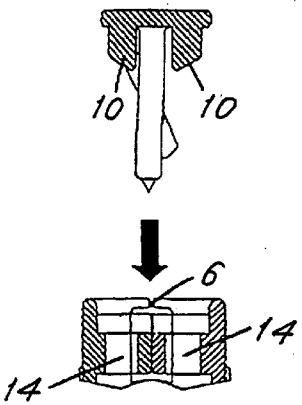
FIGS. 14A–F illustrates the movement of the security bar from a fully removed condition to a fully engaged condition with the cover shown through section EE of FIG. 2.
Figure 14B:
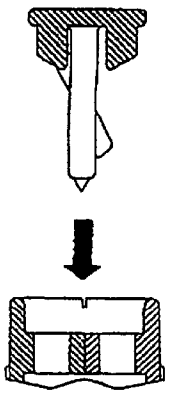
Figure 14C:
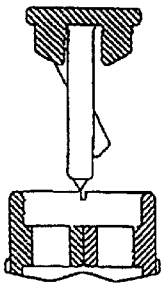
Figure 14D:
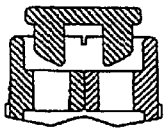
Figure 14E:
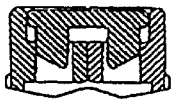
Figure 14F:
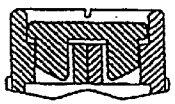
Figure 15A:
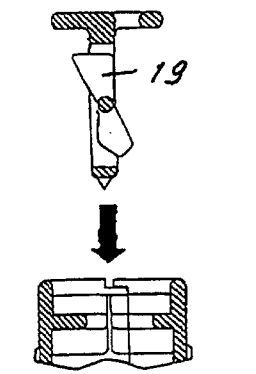
FIGS. 15A–F illustrates a series of movement of the security bar from a fully removed condition to a fully engaged condition with the cover at section DD of FIG. 2.
Figure 15B:
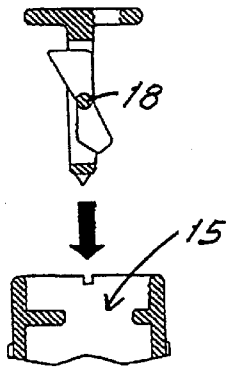
Figure 15C:
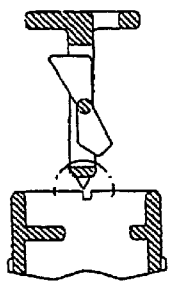
Figure 15D:
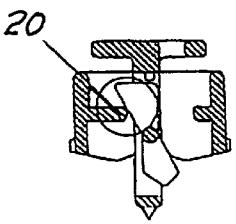
Figure 15E:
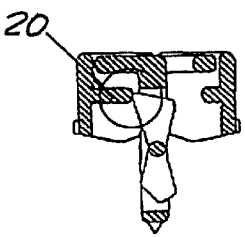
Figure 15F:
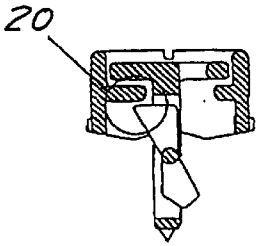

In order to ensure that the security bar can not undesirably become removed from the box, a latching means is provided. The latching means 11 preferably also extends from the same side of the face plate 9 of the security bar. When the latching means is engaged with the box, it also is provided within the boundary defined by the face plate and the box. Access cannot be gained to the latching means by a potential shop lifter. As the pins 10 are inserted into the openings 14, the latching means is also insertable simultaneously into an opening 15 which is defined by a rebate in the side wall upstands 5. These rebates 16 are positioned such that when the box is in a closed condition and allows for the latching means to be inserted internally of the walls of the lid and base portions. The latching means preferably comprises a slide member 17 which acts as a guide for the movement of the security bar into the box. The slide member 17 also provides a pivot point 18 about which a latch 19 is able to pivot. The latch 19 is able to pivot about the pivot 18 provided by the latching means to move between a latching position and a released position. The latch 19 is preferably integrally molded as part of the security bar and it is the inherent plasticity of its material which allows for pivoting of the latch 19 about the pivot 18. Indeed, in a rest position the latch 19 is in the latching position and the pivot 18 is required to be stressed to move the latch to the release position. The latch position is as for example shown in FIG. 15A or in FIG. 7. This is the natural position of the latch 19. A flange 20 is provided as part of the box such that it is engaged by the latch when the latch 19 is in a position where the pins 10 are fully engaged with there respective openings 14. The latch presents a surface to locate against a surface of the flange which then prevents the removal of the security bar from the box. The latch itself in moving into the latching position and positioned where the security bar is locked to the box, moves to allow a one-way insertion of the latch into the box past the flange 20 until such time as the latch passes the flange whereupon the latch will restore to its latching position then preventing the retraction of this security bar from the box. If an attempt to retract the security bar is made, the fact that the flange 20 makes contact with the latch 19 off center (in the direction of retraction) movement of the latch to the release position will not be possible. FIGS. 21–24 illustrate the sequence of insertion of the security bar into the box. Where the security bar also provides the planar member, the side wall upstand of the lid 3 is provided with a slot 22 into which the planar member can slide as the security bar is moved from a retracted position to a position to lock the box. The planar member is then placed within the boundaries of the box and indeed the only visible observation that can be made of the security device of the present invention is that the face plate 9 of the security bar remains exposed and visible from the exterior of the box. This face plate may include graphics to warn a potential shop lifter of the presence of the security device.

Where the planar member is provided in the lid 3 and with reference to FIG. 8, the lid includes a slot 22 and a guide portion 23 to guide the movement of the planar member into the box. Since the lid also includes the clipping features for clipping a booklet to the inside face of the lid, in order to prevent damage to the booklet occurring, ramp features 24 are provided. These lift the booklet away from the inward surface of the lid, at least at the point where the planar member is introduced into the box.

These ramp features 24 lift the booklet up to allow for the planar member to be slid thereunder. This will prevent the booklet from getting damaged upon the insertion of the planar member into the box.

Figure 7:
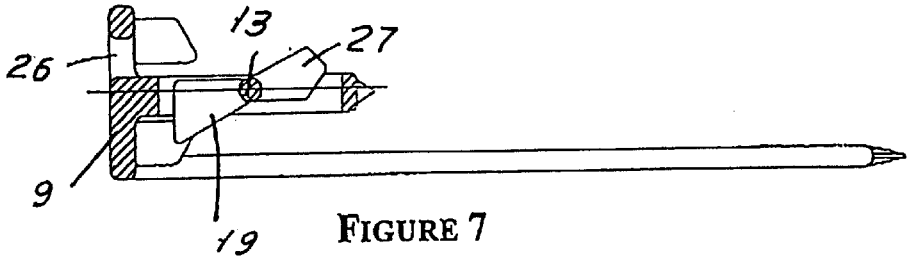
FIG. 7 is a sectional view through section C—C of FIG. 6.
Figures 16A, 16B, 16C, 16D, 16E, 16F:
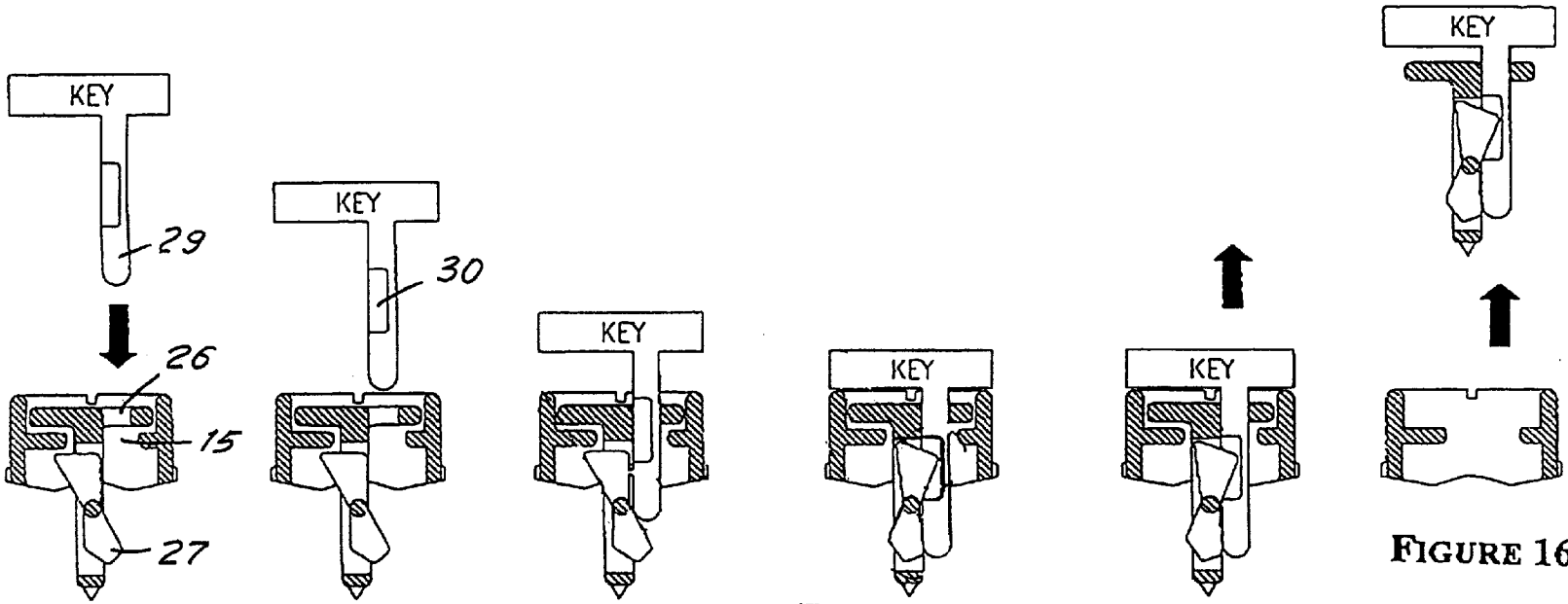
FIGS. 16A–F shows the steps of removal of the security bar from the cover at section DD.

The opening defined by the rebates 16 of each of the lid and base portion provides not just sufficient room for the latching means to be inserted but for a key to also be inserted for the removal of the security bar. The face plate 9 as shown in FIG. 7 also includes an opening 26 through which a portion of a removing key can be inserted through to gain access to the release latch 27 of the latching mechanism. The release latch 27 is integrally formed with the latch 19 to be pivotable therewith and about the pivot 18. The release latch 27 presents a surface which upon the engagement of a key, for example as shown in FIGS. 16A–16F, allows for the surface to be contacted to thereby displace the release latch as well as the latch 19 about the pivot axis 18 to move the latch to the released position as shown in FIG. 16D. The key member has an insertable portion 29 moveable through the opening 26 of the face plate and the opening 15 of the box to become engaged with the release latch 27. The key also includes a rebate 30 which when the insertable portion engages with the release latch 27 and pivots the latch 19 to the release position, can accommodate at least part of the latch. When in the release position, the latch is no longer able to engage with the flange 20 of the box and the security bar can then be removed.

The sequence of removal is shown in FIGS. 16A–F and also in FIGS. 17–20. As can be seen in FIGS. 17 and 19, there are preferably provided two latching mechanisms and a key to engage simultaneously with both latching mechanisms.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A media storage box with security against opening, comprising:

the box comprising a base portion and a lid portion each having sides and the base and lid portions being hinged to each other along respective first sides thereof to be moveable between an open condition providing access to the space between the base portion and the lid portion and a closed condition, substantially enclosing the box and preventing access into the box; each of the base portion and lid portion having side wall up stands along at least respective second sides thereof and the second sides being so located and the upstands thereof being so shaped and positioned as to define a seam between the up stands at the second sides of the base and lid portions;

a respective lock pin receiving region on each of the sidewall upstands of the base portion and the lid portion, when the box is in the closed condition, the lock pin receiving regions being on opposite sides of the seam; an internal latching region inside the box and inside the side wall upstands;

a separate security bar which is moveable to engage the box in a locking position and which is also removable from the box, the security bar comprising:

at least one pair of locking pins, each pin of the pair being respectively engageable with the respective lock pin receiving region of the base portion and the lid portion in the locking position of the security bar such that with the pins in their respective lock pin receiving regions, the pins cooperate with the wall upstands of the lid portion and the base portion to prevent hinged opening of the lid portion from the base portion keeping the box in the closed condition;

a latch positioned on the security bar so that when the pins are in the respective lock pin receiving regions, the latch is inserted past the wall up stands of the base portion and the lid portion and into the internal latching region of the box, where the latch and the internal latching region are shaped and positioned to latch to each other to prevent removal of the lock pins from the respective lock pin receiving regions and the latch and the internal latching region being operable for releasing the latching of the latch to the internal latching region, thereby permitting removal of the locking pins from the respective locking pin receiving regions and thereby freeing the security bar for removal away from the wall upstands of the base portion and the lid portion;

wherein a movement of the security bar for engagement with the box is in a direction substantially parallel with major surfaces of the lid and base portion when the box is in the closed position.

2. The media storage box bar of claim 1, further comprising a key operable from outside the box through the wall upstands to engage the latch and move the latch from a latched position with the internal latching region to an unlatched position for permitting removal of the security bar from the locking position.

3. The media storage box of claim 1, wherein the security bar has a first surface and a plurality of the pairs of pins being disposed at intervals along the first surface of the security bar; the respective wall upstands of the base portion and the lid portion of the box having respective lock pin receiving regions disposed at intervals along the wall upstands corresponding to the intervals of the locking pins along the first surface, whereby the respective lock pin receiving regions receive the locking pins and prevent the opening of the box from the closed condition.

4. The media storage box of claim 3, wherein each of the lock pin receiving regions comprises a respective opening in the wall upstands of the base portion and the lid portion and the openings are respectively located and shaped to cooperate with and receive the respective lock pins.

5. The media storage box of claim 1, wherein the latch on the security bar includes a latch body which is pivotable between a latching position and a latch releasing position; a surface in the internal latching region positioned for being engaged by the latch in the latching position and to not be engaged by the latch when the latch is pivoted into the releasing position, whereby with the latch in the latching position, the latch engages the surface in the internal latching region to prevent removal of the security bar from the wall upstands of the lid portion and the base portion of the box.

6. The media storage box of claim 5, wherein the internal latching region in the box comprises a flange in the box engageable by the latch.

7. The media storage box of claim 5, wherein the wall upstands have an opening shaped and sized to permit passage therethrough of the latch, and the internal latching region being in the box beyond the opening and positioned to receive the latch.

8. The media storage box of claim 5, further comprising a key insertable through the wall upstands, the key being shaped and operable when inserted into the box for pivoting the latch between the latching position and the releasing position.

9. The media storage box of claim 3, wherein the security bar is plate-shaped with the pins and the latch on the first surface thereof.

10. The media storage box of claim 9, wherein the security bar is of a length and height less than the length and height of a respective side of the box comprised of the wall upstands of the lid portion and of the base portion with the box in the closed condition.

11. The media storage box of claim 1, wherein the wall upstands are on the second side of the box that is opposite to the first side of the lid portion and the base portion which are hinged together.

12. The media storage box of claim 1, further comprising a security tag or label on the security bar and insertable into the box with the latch.

13. The media storage box of claim 12, wherein the security bar has a plate projecting from the first surface and that passes through the wall upstands when the security bar is placed into the locking position; the security tag or label being placed on the plate.

14. The media storage box of claim 1, further comprising a security tag or label supported on the security bar and positioned to be protected by the security bar against contact with the tag or label.

* * * * *